United States Patent [19]

Dholakia et al.

[11] 4,418,500

[45] Dec. 6, 1983

[54] GRINDING APPARATUS

[75] Inventors: Anil R. Dholakia, East Windsor; Vincent J. Ruggeri, Howell, both of N.J.

[73] Assignee: RCA Corporation, New York, N.Y.

[21] Appl. No.: 292,283

[22] Filed: Aug. 12, 1981

[51] Int. Cl.[3] ..... B24B 9/16; B24B 41/06

[52] U.S. Cl. ..... 51/125.5; 51/216 H; 51/229

[58] Field of Search ..... 51/125.5, 125, 229, 51/131.1, 121, 216 H, 64, 65, 220; 369/71, 170–173

[56] References Cited

U.S. PATENT DOCUMENTS

| | | | |
|---|---|---|---|
| 2,205,964 | 6/1940 | Taylor | 51/221 R |
| 2,215,694 | 9/1940 | Francis | 51/216 H |
| 2,840,902 | 7/1958 | Iannetti | 30/104 |
| 3,439,456 | 4/1969 | Bailey | 51/125 |

FOREIGN PATENT DOCUMENTS

| | | | |
|---|---|---|---|
| 120888 | 6/1946 | Australia | 51/229 |
| 111092 | 6/1900 | Fed. Rep. of Germany | 51/229 |
| 637348 | 6/1928 | France | 51/229 |
| 2026357 | 2/1980 | United Kingdom | 51/125.5 |

*Primary Examiner*—Harold D. Whitehead
*Assistant Examiner*—Robert A. Rose
*Attorney, Agent, or Firm*—Birgit E. Morris; Joseph D. Lazar

[57] ABSTRACT

An apparatus for grinding two flats of substantially the same dimensions in portions of a conical tip of an element. The apparatus comprises, in combination, a rotatably mounted holding member for holding the element; a rotatably mounted abrasive surface for grinding the tip portion; an index wheel drivingly connected to a flipping lever on the holding member for rotating the element between the two tip portions wherein the point of the tip does not disturb or penetrate the abrasive surface during rotation; and a pivot bearing upon which the holding member is pivotally mounted for contacting the tip portions with the abrasive surface so that a constant force is applied to the tip portion being ground, wherein the tip point does not disturb or penetrate the abrasive surface and wherein the tip remains in contact with the abrasive surface during rotation.

8 Claims, 5 Drawing Figures

10
2
4
6
7
8
12
14
16
18
20
24
26
28
30

GRINDING APPARATUS

This invention relates to an apparatus for grinding flats in a conical tip. More particularly, this invention relates to an apparatus which may be used in the production of capacitive electronic disc playback styli.

BACKGROUND OF THE INVENTION

Matsumoto in U.S. Pat. No. 4,165,560 has disclosed a method for manufacturing a diamond playback stylus for use with a capacitive information disc system. A conical tip is ground into one end of the diamond dielectric support element. An electrode-bearing surface is formed in the tip. A record-engaging surface substantially orthogonal to the electrode-bearing surface is formed in the tip. Two surfaces which converge and are substantially flat are formed such that the intersections of the two flat surfaces with the record-engaging surface define the sides of the record-engaging surface.

Dholakia in a copending application entitled "FLIP-FLOP GRINDING METHOD," Ser. No. 292,284 filed Aug. 12, 1981 incorporated herein by reference, discloses a method for preparing a capacitive information disc playback stylus where two flats of substantially the same dimensions are lapped in a cone-shaped tip of a stylus support element. The method includes the steps of contacting a first region of the tip wherein a flat is to be lapped with an abrasive lapping surface for a predetermined time, rotating the element to a second region wherein a flat is to be lapped while the cone is in contact with the lapping surface without the cone tip disturbing or penetrating the lapping surface, contacting the second region of the cone with the abrasive lapping surface for a predetermined time, and repeating these steps until the two flats have been lapped.

It would be advantageous to have an apparatus suitable for carrying out the flip-flop lapping method of Dholakia.

SUMMARY OF THE INVENTION

We have made an apparatus for grinding two flats of substantially the same dimensions in portions of a conical tip of an element. The apparatus comprises means for holding the element, a rotatably mounted abrasive surface for grinding the tip portion, means for rotating the element between the two tip portions wherein the point of the tip does not disturb or penetrate the abrasive surface during rotation, and means for contacting the tip portions with the abrasive surface so that (1) a constant force is applied to the tip portion being ground, (2) the tip point does not disturb or penetrate the abrasive surface, and (3) the tip remains in contact with the abrasive surface during rotation.

DETAILED DESCRIPTION OF THE INVENTION

Figures 1A, 1B, 1C:
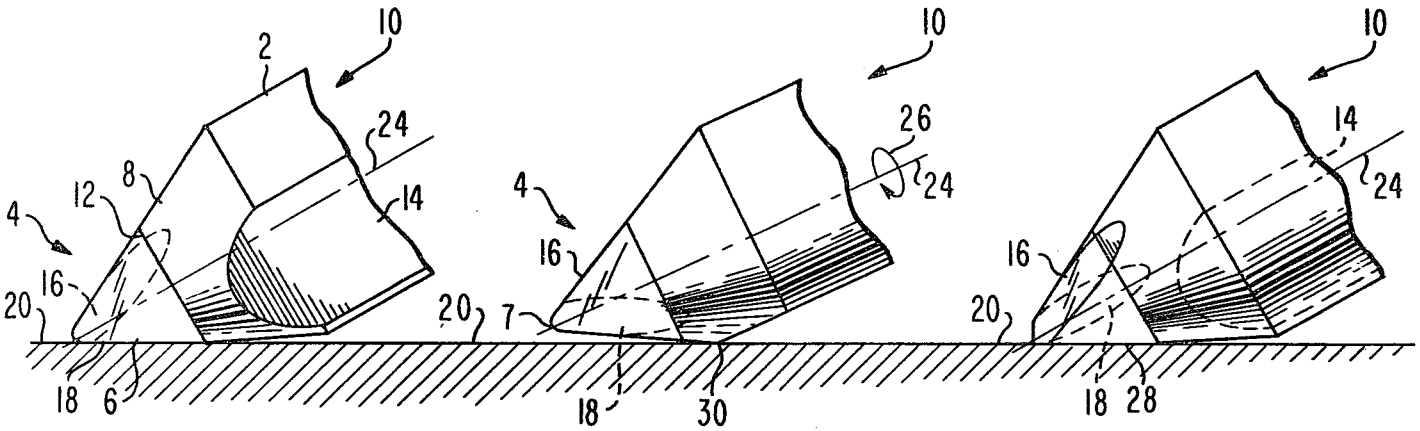
FIGS. 1A, 1B and 1C are elevation views illustrating the flip flop grinding of two flats and the rotation of the element.

The present invention will be illustrated by means of the Drawing. FIGS. 1A, 1B, and 1C are elevation views of a stylus element 10 during the flip flop grinding operation. The stylus element 10 has a shank 2 and a conical tip region 4. The shank 2 material may be, for example, a metal such as titanium or the same material as that which will contact with a capacitive information disc during playback, for example, sapphire, diamond, and the like. The tip region 4 may consist of two tip components 6 and 8 wherein the first tip region component 6, which terminates at tip end 7, includes the tip region 4 portion which will contact the capacitive information disc during playback and is generally a hard dielectric material, such as diamond, sapphire, and the like. The second tip component 8 may be fabricated from the same material as the first tip component 6 or the shank region material 2. An interface 12 between the second tip component 8 and the first tip component 6 is shown for the case where the first and second tip components 6 and 8, respectively, are fabricated from different materials. The two tip component regions 6 and 8 may be bonded at the interface 12 by brazing, soldering, or by any other suitable method known in the art. A reference flat 14 has been machined into the stylus element 10 along the shank 2 and extending into the tip region 4 for orientation and alignment purposes.

An electrode surface 16 has been lapped in the tip region 4 as a flat opposite the reference surface 14. In lapping the electrode surface 16, as well as in lapping other flats, any convenient method may be employed. When the first tip component 6 is diamond, a diamond powder having an average particle diameter of between about 0.1 and 0.25 micrometer may be employed as a charge on a scaife which acts as the abrasive lapping surface 20.

In FIG. 1A, a first flat 18 is being lapped in the tip region 4 on the abrasive lapping surface 20. In FIG. 1B, the stylus element 10 is being rotated about its major axis 24. The direction of rotation is shown by an arrow 26. The tip end 7 is elevated during the rotation process. The tip region 4 rotates about a pivot 30 which is a portion of the tip region 4. In FIG. 1C, the second flat 28 is being lapped. The flip flop steps as shown in FIGS. 1A, 1B, and 1C are repeated until the flats 18 and 28 have been lapped with the desired dimensions.

Figure 2:
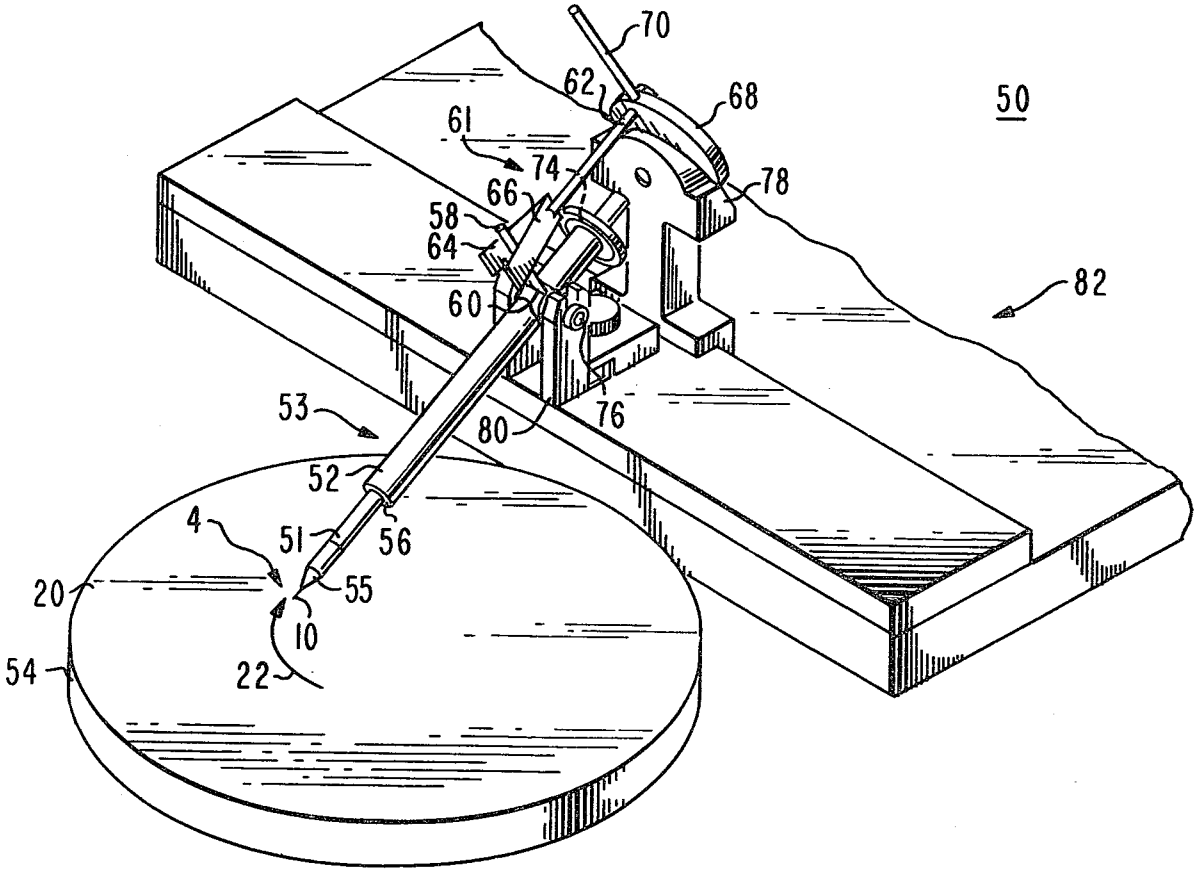
FIG. 2 is a perspective view of an apparatus of the present invention.
Figure 3:
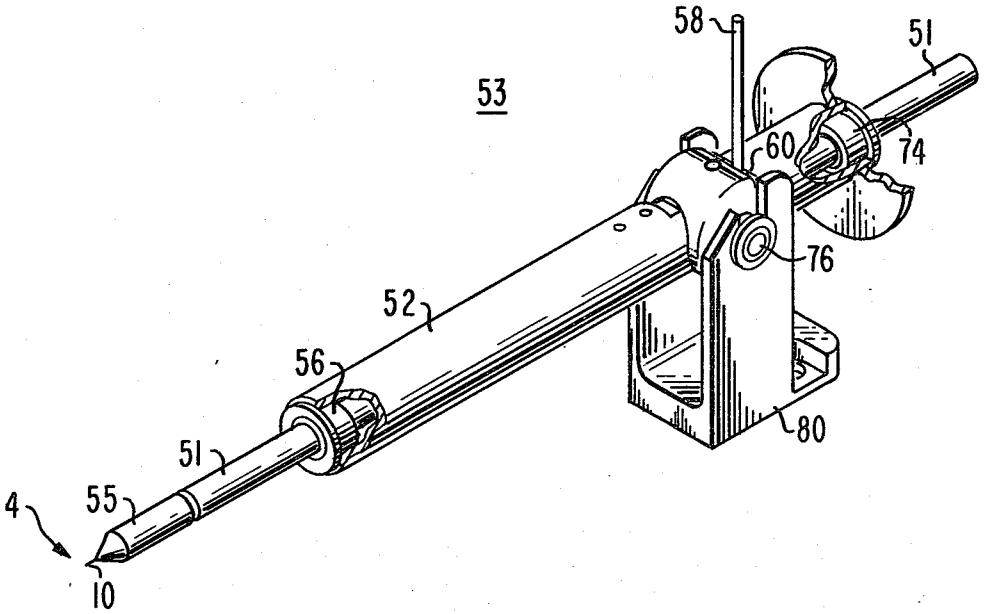
FIG. 3 is a perspective view of a stylus element holding assembly of an apparatus of the present invention.

FIG. 2 is a perspective view of a flip-flop grinding apparatus 50 of the present invention suitable for carrying out the flip-flop grinding of a stylus element 10. The flip-flop grinding apparatus 50 includes a scaife 54 having an abrasive lapping surface 20. The direction of rotation of the scaife 54 is shown by an arrow 22. The stylus element 10 is mounted in a stylus element holding assembly 53, also shown in FIG. 3. The stylus element holding assembly 53 includes a holding member 51 having a pair of jaws 55 at one end for securely holding the stylus element 10. The holding member 51 is mounted in a shaft 52 by means of a first bearing 56 and a second bearing 74.

The shaft 52 containing the holding member 51 and the stylus element 10 is held on the scaife 54 by means of a pivot bearing 76 such that the desired constant force is applied to the stylus tip region 4 by mass loading. Generally, a force of between about 2 and 5 grams is preferred. Too much force, for example about 50–100 grams, results in damage to the abrasive lapping surface 20; too little force, for example about 0.5 gram, results in a longer time needed to grind the flats 18 and 28, as well as possible increased vibration of the tip region 4 which can cause gouging and non-uniformity of the flats 18 and 28. In the present invention the use of mass loading to obtain a constant force between the stylus tip region 4 and the abrasive lapping surface 20 is important to ensure that both faces will be equally lapped when subject to the abrasive lapping surface 20 for substantially the same duration.

A slot 60 allows a flipping lever 58 to rotate within a preset arc determined by the slot 60 length. The slot 60 length and arc relate to the desired angle between the first flat 18 and the second flat 28.

A fork assembly 61 includes a fork shaft member 62, a first fork member 64, and a second fork member 66. The first fork member 64 and the second fork member 66 may be constructed from a flexible material such as a plastic, for example, a cellulose acetate sheet, or a metal sheet or wire. The first fork member 64 and second fork member 66 are arrayed so as to bracket the flipping lever 58.

The fork shaft member 62 is attached at the end opposite that connected to the first and second fork members 64 and 66, respectively, to an index wheel 68 such that the maximum rotation in one direction of the index wheel 68 corresponds to that for the flipping lever 58 and for a fork member 64 and 66 of the fork assembly 61. Attached to the index wheel 68 is a rocker arm 70 which is used to rotate the index wheel 68 either manually or by mechanical means to an angle somewhat greater, generally about 3 to 4 degrees, than that of the slot length through which the flipping lever 58 rotates. The greater angle of rotation of the index wheel 68 causes a small pressure to be applied to the flipping lever 58 by the first fork member 64 or the second fork member 66 at the ends of the rotation arc. This pressure keeps the flipping lever 58 in position during the lapping of the two flats 18 and 28 in the tip region 4. Generally a force of between about 25 and 50 milligrams, as applied by the fork members 64 and 66, is preferred. Too much force, for example, about 500 milligrams, results in the tip region 4 lifting from the abrasive lapping surface 20. Too little force, for example, about 5 milligrams, may result in the tip region 4 not being lapped in the appropriate position.

The index wheel 68 is mounted on a first housing 78, and the pivot bearing 76 is mounted in a second housing 80. The first housing 78 and second housing 80 are mounted on a support 82.

Although specific means for obtaining a constant force between the tip region 4 and the abrasive lapping surface 20 are shown, it is to be understood that other means besides mass loading may be employed. Similarly, although the fork assembly 61 is shown as a means for ensuring contact of the same portion of the stylus tip region 4 with the abrasive lapping surface 20 after each rotation, other means may also be employed. The present apparatus may also be modified so that the rotation of the index wheel 68 occurs by use of a suitable motor. The flip flop grinding apparatus 50 may also be automated.

Illustratively, the index wheel 68 may be fabricated out of 3/16 inch (4.77 millimeters) thick aluminum with a diameter of 1.5 inches (38.1 millimeters). The index wheel 68 is mounted at an angle of 30 degrees to the vertical by means of a $\frac{1}{8}$ inch (3.18 millimeters) pivot pin, not shown. The brass rocker arm 70 is 1.75 inches (4.45 millimeters) long having a diameter of 0.062 inch (1.57 millimeters). The aluminum fork shaft member 62 is $1\frac{7}{8}$ inches (47.6 millimeters) long with a diameter of $\frac{1}{8}$ inch (3.18 millimeters). The fork shaft member 62 is attached to the index wheel 68 by means of a lock nut. The fork members 64 and 66 are 0.005 inch (0.13 millimeter) thick, $\frac{3}{4}$ inch (19.1 millimeters)×5/16 inch (7.94 millimeters) cellulose acetate sheets.

An aluminum shaft 52 is 4 inches (10.2 centimeters) long with an outer diameter of 5/16 inch (7.94 millimeters). A 4.5 inch (11.4 centimeters) long aluminum holding member 51 with a $\frac{1}{8}$ inch (3.18 millimeters) diameter is held in place in the shaft 52 by means of two ball bearings 56 and 74. A 0.012 inch (305 micrometers) diameter titanium shank 2 is grasped by a $\frac{1}{2}$ inch (12.7 millimeters) long pair of hardened steel jaws, not shown, at the end of the holding member 51.

A first tip material 6 is an unoriented diamond having a height from the tip end 7 to the interface 12 of 6 milliinches (152 micrometers). The second component 8 is titanium. The stylus element has a cone angle in the tip region 4 of 50 degrees. The shank 2 diameter is 12 milliinches (305 micrometers). The diamond was bonded to the titanium by brazing. The length of the titanium is 100 milli-inches (25.4 milli-meters). A reference flat 14 was employed to orient the stylus element 10 in the jaws of the holding member 51.

The axes of the stylus element 10, the holding member 51, and the shaft member 52 are aligned at an angle of 30 degrees to the abrasive lapping surface 20.

An electrode surface 16 is lapped into the tip region 14 opposite the reference flat 14 as shown in FIG. 2. The electrode surface 16 makes an angle of 30 degrees with the stylus element axis 24.

Two flats 18 and 28 were lapped into the stylus element 10 by means of the flip-flop grinding apparatus 50, as shown in FIG. 2, which was operated manually. A cast iron scaife 54 rotated at 3600 revolutions per minute. The abrasive surface 20 was charged with a diamond powder having an average particle size of 0.1 micrometer.

Initially each region wherein a flat was to be lapped was contacted with the abrasive surface 20 for 5 seconds. The time spent rotating the stylus element 10 between the two regions was 0.5 second. Three complete cycles were run so that the total lapping time for each region was 15 seconds. The time each flat was lapped was then increased to 15 seconds. Three complete cycles were run so that each flat was lapped for 0.75 minute. The electrode surface angle at tip end 7 after lapping of the flats 18 and 28 was completed was 100 degrees. The angle between the two lapped flats 18 and 28 was 104 degrees. Each flat 18 and 28 was ground at an angle of 30 degrees to the stylus element axis 24. After flip-flop grinding was completed, the tip end 7 was centered on the electrode surface 16.

We claim:

1. In an apparatus for grinding two flats of substantially the same dimensions in two portions of a conical tip of a stylus element comprising:

(a) means for holding the element, (b) a rotatably mounted abrasive surface for grinding the tip portion, (c) means for rotating the element between the two tip portions wherein the point of the tip does not disturb or penetrate the abrasive surface during rotation of the element, and (d) means for contacting the respective tip portions with the abrasive surface so that a constant force is applied to the tip portion being ground, wherein the tip point does not penetrate or disturb the abrasive surface and wherein the tip remains in contact with the abrasive surface during rotation of the element;

wherein the element holding means is a stylus element holding assembly comprising a holding member to which the stylus element is attached at one end, and a shaft in which the holding member is rotatably mounted;

wherein the element rotating means includes an index wheel drivingly connected to the stylus element holding assembly; and wherein the stylus element holding assembly includes a flipping lever and the index wheel is drivingly connected to the flipping lever;

wherein the improvement comprises a fork assembly having flexible fork members attached to the index wheel wherein the fork assembly is drivingly connected to the flipping lever, whereby substantially the same tip portions are in contact with the abrasive surface after each alternate rotation.

2. An apparatus in accordance with claim 1 wherein the shaft has a slot therein and a flipping lever is attached to the holding member and extends through the slot in the shaft.

3. An apparatus in accordance with claim 2 wherein the slot in the shaft is of a length corresponding to the angle between the two flats and wherein the ends of the slot correspond to the portions of the conical tip wherein the two flats are to be ground.

4. An apparatus in accordance with claim 1 which additionally contains means for providing that the same tip portions are in contact with the abrasive surface after each rotation when the flats are being ground.

5. An apparatus in accordance with claim 1 wherein the means for contacting the tip portions includes a pivot bearing on which is pivotally mounted the stylus element holding assembly so that the stylus element holding assembly is mass-loaded to have the desired constant force.

6. An apparatus in accordance with claim 1 wherein the angle of rotation of the index wheel is greater than the angle of rotation of the flipping lever.

7. An apparatus in accordance with claim 1 wherein the rotatably mounted abrasive surface is a scaife.

8. An apparatus in accordance with claim 7 wherein the scaife is charged with diamond particles.

* * * * *